United States Patent [19]

Barth

[11] Patent Number: 4,775,169

[45] Date of Patent: Oct. 4, 1988

[54] PRE-LINED ART SHEET MEMBER

[76] Inventor: Thomas M. Barth, 29 Industrial Park Dr., Hendersonville, Tenn. 37075

[21] Appl. No.: 915,420

[22] Filed: Oct. 6, 1986

[51] Int. Cl.[4] ..... B42D 15/00; A47B 27/00

[52] U.S. Cl. ..... 283/1 A; 312/231

[58] Field of Search ..... 283/1 A; D6/420; D19/35, 52; 33/430; 248/441.1; 401/267; 434/85, 128; 312/230, 231; 269/302.1; 52/241; D15/1, 10; D20/10

[56] References Cited

U.S. PATENT DOCUMENTS

| | | | |
|---|---|---|---|
| D. 206,169 | 11/1966 | Gerber | D6/420 |
| 464,359 | 12/1891 | Hagan | 434/90 |
| 1,376,098 | 4/1921 | Jones | 283/1 A |
| 1,377,855 | 5/1921 | Smith | 283/1 R |
| 2,632,683 | 3/1953 | Sterling | 312/231 |
| 3,132,439 | 5/1964 | McGill | 312/231 |
| 3,392,955 | 7/1968 | Cole | 312/231 |
| 3,630,588 | 12/1971 | Baker | 312/231 |
| 4,148,148 | 4/1979 | Riehle | 283/1 A |
| 4,295,664 | 10/1981 | Gutting | 283/1 A |

FOREIGN PATENT DOCUMENTS

| | | | |
|---|---|---|---|
| 237800 | 9/1945 | Switzerland | 434/90 |

OTHER PUBLICATIONS

Leif Wissman Associate Inc., Inquiry Card No. 302; Circle Reader Service Card No. 22.

*Primary Examiner*—E. R. Kazenske
*Assistant Examiner*—Paul M. Heyrana, Sr.
*Attorney, Agent, or Firm*—Harrington A. Lackey

[57] ABSTRACT

A pre-printed art sheet member having permanently impressed border lines, fold lines, and printing marks and indicia to facilitate the preparation of advertising lay-outs and printed advertisements.

18 Claims, 4 Drawing Sheets

PRE-LINED ART SHEET MEMBER

BACKGROUND OF THE INVENTION

This invention relates to pre-lined art board sheet member, and more particularly to an art sheet member which is pre-lined for the preparation of printed advertising media.

In the preparation of advertising material for printed advertising, plain, unlined art board is used by the advertising artist to prepare lay-outs, and after approval by the advertiser, the completed advertising illustration and text. The completed advertising material is then submitted to the color separator who prepares film of the different color separations, which in turn is presented to the printer. The printer then places the different colored film into chases or vacuum frames for preparation of the color plates for the printing press.

The original borders, center lines, and fold lines are laid out upon the art board for each separate advertising material by the advertising artist. After the printer receives the color films, he must extend the various border center lines and other lines upon the film for registration with his printing plates, in order for the artwork to properly register on the printed pages. A certain amount of time must be spent by the artist for each different advertising lay-out, just for placing the border and center lines upon the art board. Drawing and sketch lines are frequently changed upon the art board, requiring erasure and smudging.

Moreover, because the artist has to measure and draw the border, center lines and fold lines for each new advertising creation, errors are frequently made which continue into the completed advertising material. Such errors can be quite expensive causing complete re-printing of numerous pages of advertising material, re-assembly of the print chases and printing plates, and even re-preparing the lay-outs and completed advertising drawings. Such errors can create considerable amounts of wasted time and money, as well as missed deadlines.

SUMMARY OF THE INVENTION

It is therefore an object of this invention to provide an art sheet member particularly useful for the preparation of printed advertising material, in which many of the border, center, and fold lines, as well as certain printer's marks and indicia are pre-formed on the art sheet member initially used by the advertising artist.

Such pre-lined art sheet members will not only eliminate previous preliminary steps of manually lining the sheet member by the advertising artist, but will also form such lines more uniformly and more accurately than the previous manually formed lining. Moreover, the additional printer's markings tied in with the borders, center lines, and fold lines will facilitate the printing process and substantially reduce costly printing errors, as well as saving the time of the printer in establishing various indicia and registration marks necessary for the printing process.

Another object of this invention is to provide a pre-lined art sheet member in which certain lines appearing on the sheet member for use by the artist do not appear in the material printed from the sheet member.

Another object of this invention is to provide pre-printed lines upon the art sheet member to assure the containment of all the advertising material within the confines of the page space.

A further object of the invention is to provide a pre-printed art sheet member which will have a cleaner and neater appearance, particularly for presentation of the preliminary artwork to the advertiser.

The pre-printed art sheet member made in accordance with this invention is easily adapted for different types of printed advertisements, such as single sheets, leaflets, multi-panel folders, or bound pages.

DESCRIPTION OF THE PREFERRED EMBODIMENTS

Figure 1:
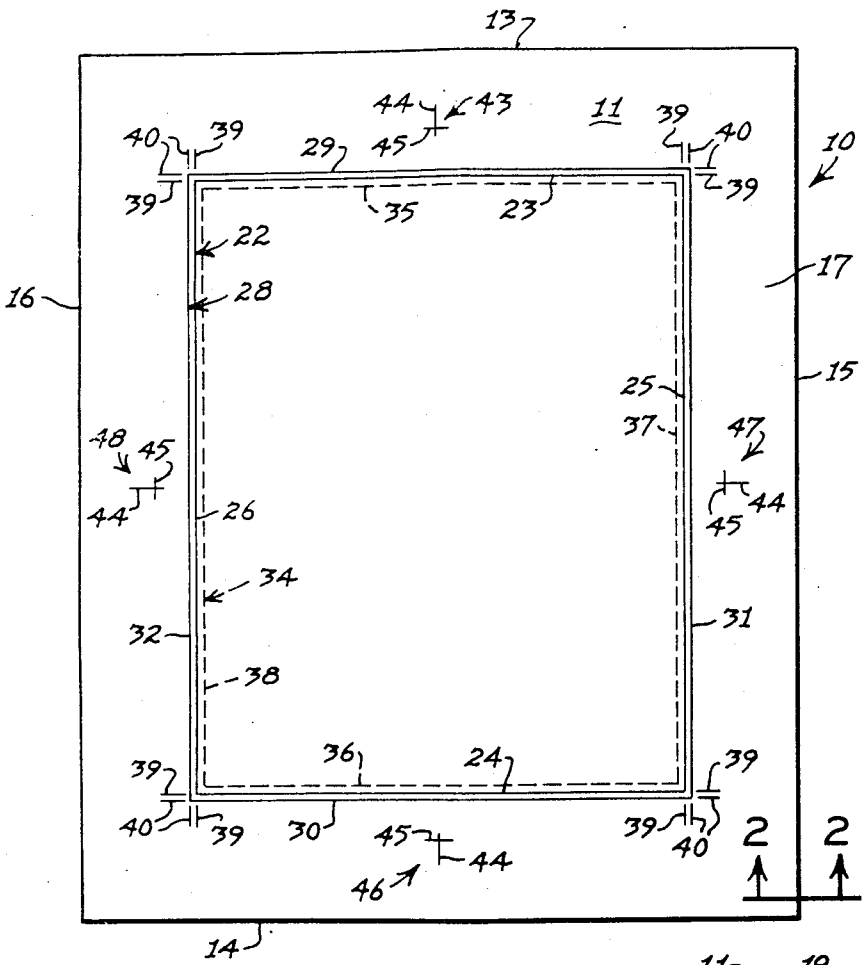
FIG. 1 is a face plan view of a pre-printed, single-page art board made in accordance with this invention.
Figure 2:
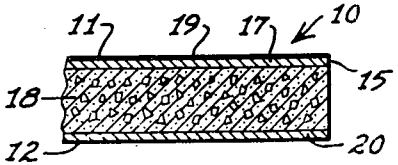
FIG. 2 is an enlarged fragmentary section taken along the line 2—2 of FIG. 1.

Referring now to the drawings in more detail, FIGS. 1 and 2 disclose a pre-lined art board 10, including art sheet or sheet member 17 made in accordance with this invention, which is to be used in the preparation of a single-sheet of printed advertising. The art sheet 17 is preferably rectangular and includes a face surface 11, a top edge 13, a bottom edge 14, a right side edge 15, and a left side edge 16. The art sheet 17 is preferably made of a good grade of paper.

The art sheet 17 may be used by itself, or it may have a rear surface mounted or laminated flush against an opposing surface of a rigid backing of chip board 18 of any desired thickness, if desired, to constitute an art board 10. Since the art sheet 17 is laminated on top of the chip board 18, then the face surface 11 of the sheet 17, also functions as the face surface of the art board 10.

Preferably, the face surface 11 of the art sheet 17 is covered with a coating 19 to permit erasure of pencil marks and lines from the face surface 11 with a minimum of smudging.

As disclosed in FIG. 2, the back of the chip board 18 may be covered by a back sheet of paper 20 having a back surface 12, if desired.

If it is desired to prepare a single sheet of advertising material on the art sheet 17 of a pre-determined size, such as $8\frac{1}{2}'' \times 11''$, then a rectangular trim border 22 is permanently impressed, such as by printing, upon the face surface 11 of the art sheet 17. The rectangular trim border 22 consists of a top trim line 23, a bottom trim line 24, a right trim line 25, and a left trim line 26. The trim lines 23–26 are straight, and preferably continuous, and have the same dimensions as the pre-determined dimension of the desired single page of the advertising material. If the advertising material is $8\frac{1}{2}'' \times 11''$ then the dimensions of the trim border 22 is $8\frac{1}{2}'' \times 11''$.

Also permanently impressed upon the face surface 11 is a second rectangular bleed line border 28 surrounding the trim border 22, the border 28 includes the top bleed line 29, the bottom bleed line 30, the right side bleed line 31, and the left side bleed line 32, each of which is parallel to its corresponding trim line. In the embodiment disclosed in FIG. 1, there is a uniform spacing between the corresponding trim lines and bleed lines.

Also permanently impressed upon the face surface 11 of the art board 10 is a third rectangular border, referred to as a hazard border 34, within the trim border 22. The hazard border 34 is composed of straight dashed lines, including the top hazard line 35, the bottom hazard line 36, the right hazard line 37, and the left hazard line 38. The top, bottom, and side hazard lines 35–38 are each parallel to their corresponding trim lines 23–26. In the embodiment of FIG. 1, all of the hazard lines 35–38 are uniformly spaced from and within the corresponding trim lines 23–26.

Formed permanently upon the face surface 11 of the art sheet 17 outside of, and adjacent the corners of the bleed line border 28 are parallel sets of trim and bleed extension lines 39 and 40. Each trim extension line 39 is an extension of each end of a trim line 23–26 beyond, that is outside of, the bleed border 28. As disclosed in FIG. 1, there are two sets of trim and bleed extension lines 39 and 40 at each corner of the bleed border 28 and disposed at right angles to each other. Accordingly, there are eight sets of trim and bleed extension lines 39, 40 located at the four corners of the bleed border 28. The length of the trim and bleed extension lines 39 and 40 are relatively short and are substantially less than the distance between the bleed border 28 and the edges 13–16 of the art sheet 17.

As shown in the drawings, there is a space between the respective trim and bleed extension lines 39 and 40, and the bleed border 28.

Also permanently impressed upon the face surface 11, such as by printing, outside the bleed border 28 are register marks for locating the center lines within the rectangular space created by the trim border 22. Spaced above the top bleed line 29 is a top register mark 43 including a pair of register lines, including a center register line 44 and a lateral register line 45 crossing and at right angles to the center register line 44.

In like manner, a bottom register mark 46 is spaced outside of and below the bottom bleed line 30, while a right register mark 47 and a left register mark 48 are spaced outside their respective right and left bleed lines 31 and 32, as illustrated in FIG. 1. Each of the register marks 46, 47, and 48, also includes a center register line 44 and a lateral register line 45 crossing each other at right angles in the same manner as the register lines 44 and 45 of the top register mark 43. The register mark 43, 46, 47, and 48 may be identical in appearance and structure, except for their orientation. Each of the center register lines 44 is disposed at right angles to its adjacent trim line 23–26, while each of the lateral register lines 45 is disposed parallel to its corresponding trim line 23–26, respectively.

Moreover, the top and bottom center register lines 44 are disposed colinear and midway between the opposite side trim lines 25 and 26. In like manner, the opposed center register lines 44 of the side register marks 47 and 48 are colinear and located midway between the top and bottom trim lines 23 and 24.

All of the register marks 43, 46, 47, and 48 are permanently impressed, such as by printing, upon the face surface 11 of the art sheet 17 outside the bleed border 28.

The art sheet 17 disclosed in FIGS. 1 and 2 is adapted to be used in the preparation of a single sheet advertisement. All of the above-described lines and register marks form a permanent part of the art sheet 17 used throughout the preparation of the advertising, including the preliminary lay-out, revisions, submission to the advertiser, final presentation, color separation process, and the printing process.

The trim border 22 defines the border of the advertising page and defines the lines along which the paper upon which the ad is placed is cut to form the edges of the advertising page.

The bleed border 28 is always outside the trim border 22 to provide an external border for the colored print material, so that when the advertising sheet paper is cut along its trim lines represented by the trim border 22, the cut will be across the colored surface in the border area and no unwanted white margin will appear outside the colored border.

The function of the hazard border 35 is to provide an imaginary border containing a working area for the commercial artist as a safety precaution to prevent the artist from placing type or any copy beyond the hazard border 35.

Figure 9:
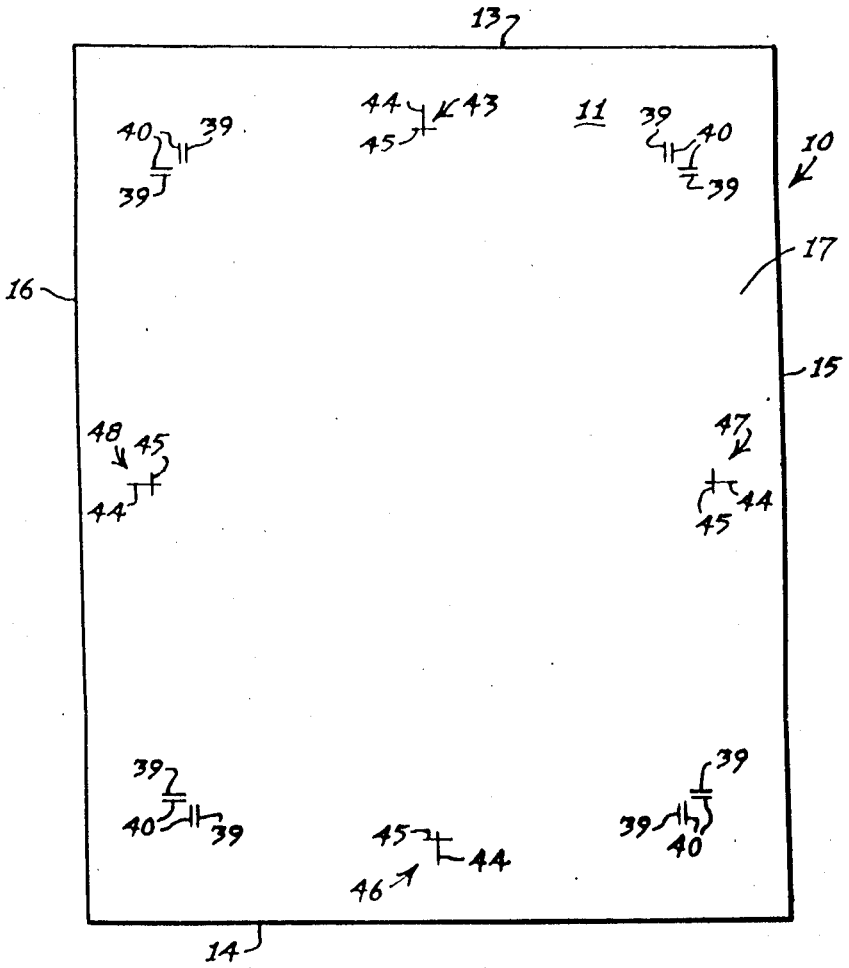
FIG. 9 is a face plan view of the pre-printed single page art board of FIG. 1, without the disappearing lines.

The bleed border 28, the trim border 22, and the hazard border 34 are primarily for utilization by the commercial artist or ad agency. Accordingly the lines of the bleed border 28, the trim border 22 and the hazard border 34 are pre-printed with an ink, such as a light blue ink, to form "disappearing lines" which will not appear in the photographing process for producing the color separations, and therefore will not appear in the final printed material or the art sheet 17, as illustrated in FIG. 9. The remaining imprinted marks, namely, the trim and bleed extension lines 39 and 40, and the register marks 43, 46, 47, and 48, are for use by the printer in establishing the trim and bleed borders and the center lines in setting up the advertising material or film for printing in the chase and the printing press. Accordingly, the extension lines 39 and 40 and the register marks 43, 46, 47, and 48 are pre-printed with a dark ink, such as a black ink, which will appear in the photographed color separations and in the final printed material and the art sheet 17, as illustrated in FIG. 9.

Since all of the lines, and particularly the trim and bleed extension lines 39 and 40 and the register marks 43, 46, 47, and 48 are pre-formed on the art sheet 17 and permanently impressed upon the face surface 11 prior to use of the art sheet by the artist, these respective lines and marks can be accurately and uniformly permanently impressed upon the face surface 11 en masse to substantially reduce errors in preparation and printing of the advertising material.

Moreover, because of the substantial reduction in errors, and the accuracy of the lines and marks, less time is required by the commercial artist for preparing his advertising material and by the printer in preparing the material for printing. One time-saving factor in the utilization of the pre-lined or sheet 17 made in accordance with this invention is the elimination of the establishing of lines and borders by the commercial artist before he commences preparing the art and advertising material.

Moreover, because of the substantial elimination of errors and the subsequent reduction of preparation time, expenses, and particularly printing expenses, are substantially reduced. When advertising material is printed en masse and an error is subsequently determined, the printing effort and the printed material are lost. Moreover, where errors must be corrected in advertising material, and particularly in printing, sometimes deadlines for publishing are missed and the cost and effort of the entire advertising program is valueless.

Figure 3:
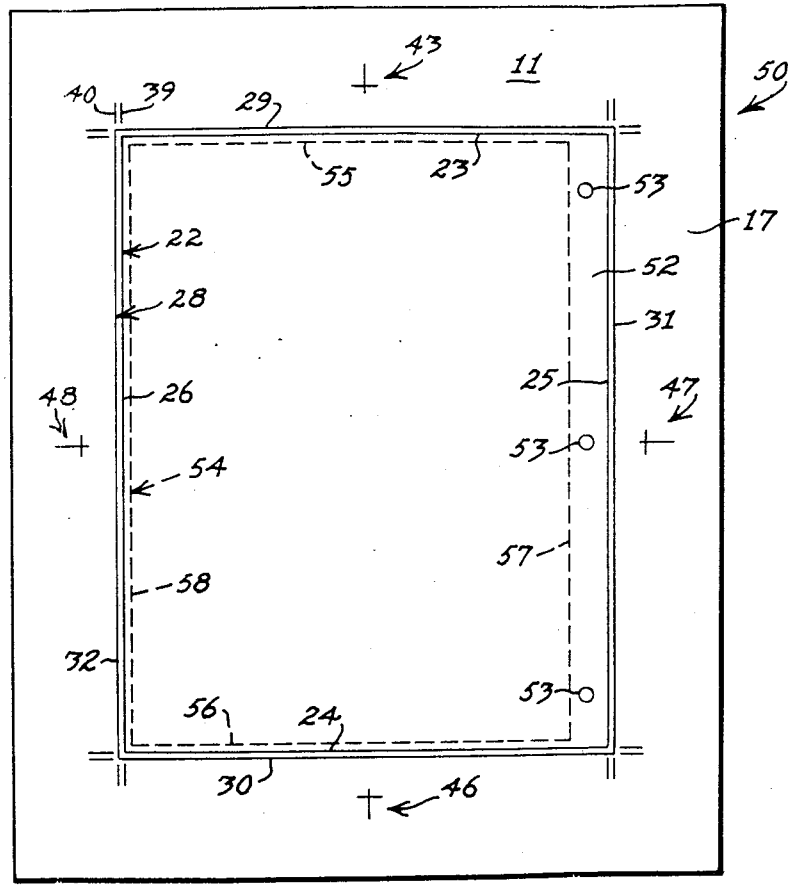
FIG. 3 is a view similar to FIG. 1 disclosing a single-page art board adapted for a binder.

FIG. 3 discloses an art board 50 which is substantially similar to the art board 10, but is pre-lined for use as a single page in a binder. All of the lines and registration marks common to those on the art sheet 17 of the art board 10 bear the same reference numbers. The main difference between the art sheets 17 of the art board 50 and the art board 10 is that the spacing between the right hazard line 57 and the adjacent side trim line 25 is greater than the spacing between the hazard lines 55, 56, and 58 and their corresponding trim lines 23, 24, and 26, to provide a binder space 52 in which are formed longitudinally spaced "disappearing" binder hole marks or circles 53, as illustrated in FIG. 3. Thus, a hazard border 54 is provided to define a work space which will provide ample clearance in the binder space 52 for binding the single page ad prepared on the art board 50 in a binder.

Figure 4:
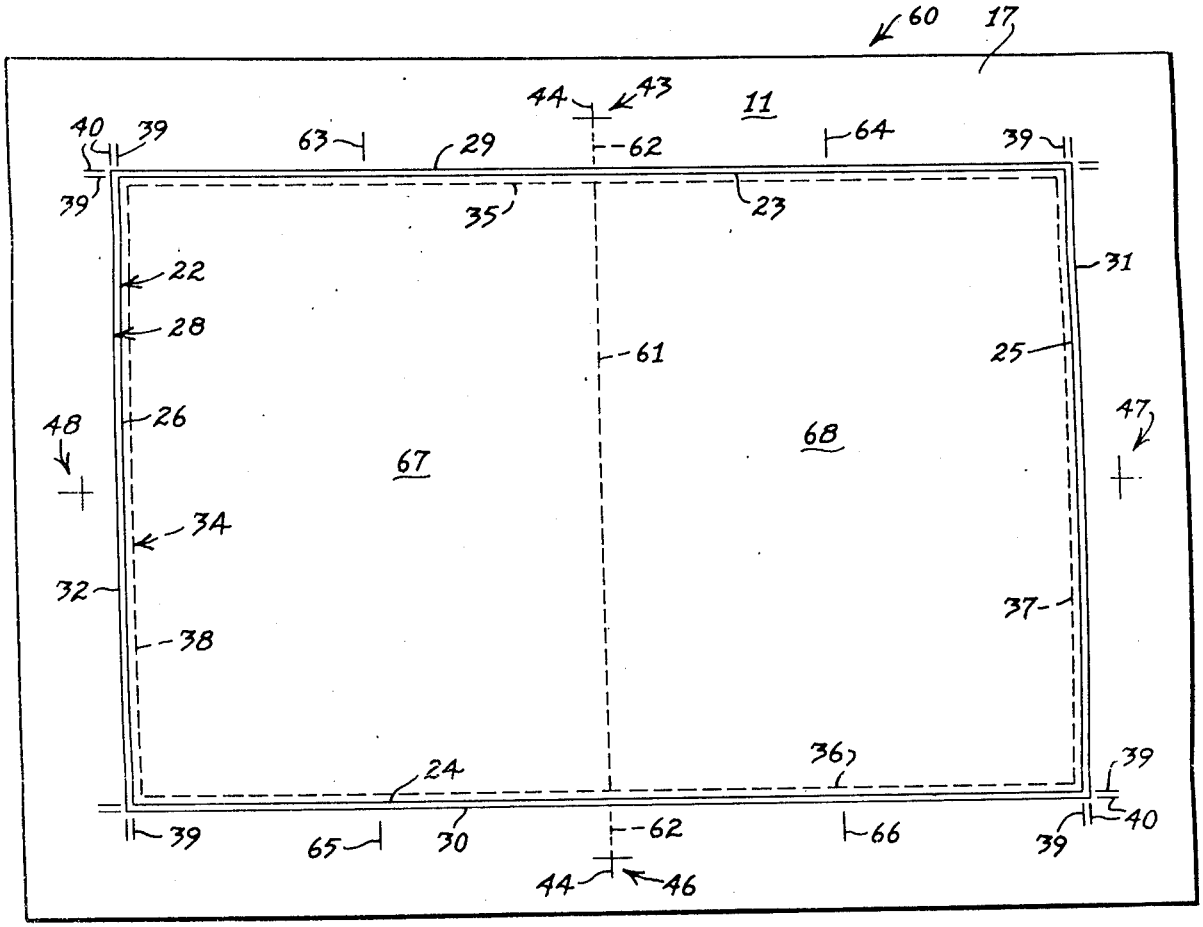
FIG. 4 is a view similar to FIG. 1 of a second modified art board designed for the production of a two-panel leaflet.

The art sheet 17 of art board 60 disclosed in FIG. 4 is a modification of the art sheet 17 the art board 10 to provide for the preparation of a folded two-page advertisement or leaflet. The rectangular borders 22, 28, and 34 are identical to those disclosed in FIG. 1, except that the width of the borders is substantially greater than the height, in order to accommodate the preparation of two pages of advertisement side by side. Moreover, the trim and bleed extension lines 39 and 40 and the register marks 43, 46, 47, and 48 are identical to those disclosed in FIG. 1.

In addition to the lines included the art sheet 17 in the art board 10, a dashed center fold line 61 and fold extension lines 62 are permanently impressed upon the face surface 11 of the art sheet 17 in FIG. 4 to lie coincident with the center register lines 44 of the top and bottom register marks 43 and 46. Thus, the center fold line 61 divides the trim border 22 in half to provide dual pages for the advertising leaflet.

Furthermore, top center page lines 63 and 64 are permanently impressed on the face surface 11 above the top bleed line 29, and bottom center page lines 65 and 66 are permanently impressed on the face surface 11 spaced below the bottom bleed line 30, to provide upright or vertical center lines for the corresponding page areas 67 and 68. The lines 63 and 65 are located in vertical alignment and midway between the fold line 61 and the left trim line 26, while the center page lines 64 and 66 are colinear and located midway between the fold line 61 and the right trim line 25.

Thus, the center fold line 61 divides the work area for the artist into the two-page areas 67 and 68 defined by the center fold line 61 and the remaining dashed lines in the hazard border 34. The center line 63, 64, 65, and 66 are also imprinted for use by the artist. Accordingly, the center fold line 61 and the center lines 63–66, as well as the trim border 22, bleed border 28 and the hazard border 34 constitute light "disappearing lines", as previously described.

The center fold extension lines 62, as well as the extension lines 39 and 40 and the register marks 43, 46, 47, and 48, outside of the bleed border 28, provide the necessary marks for the printer to accurately establish the location of the advertising material or film for the printing press, and consequently are pre-printed in dark lines appearing in the final printed material.

Figure 5:
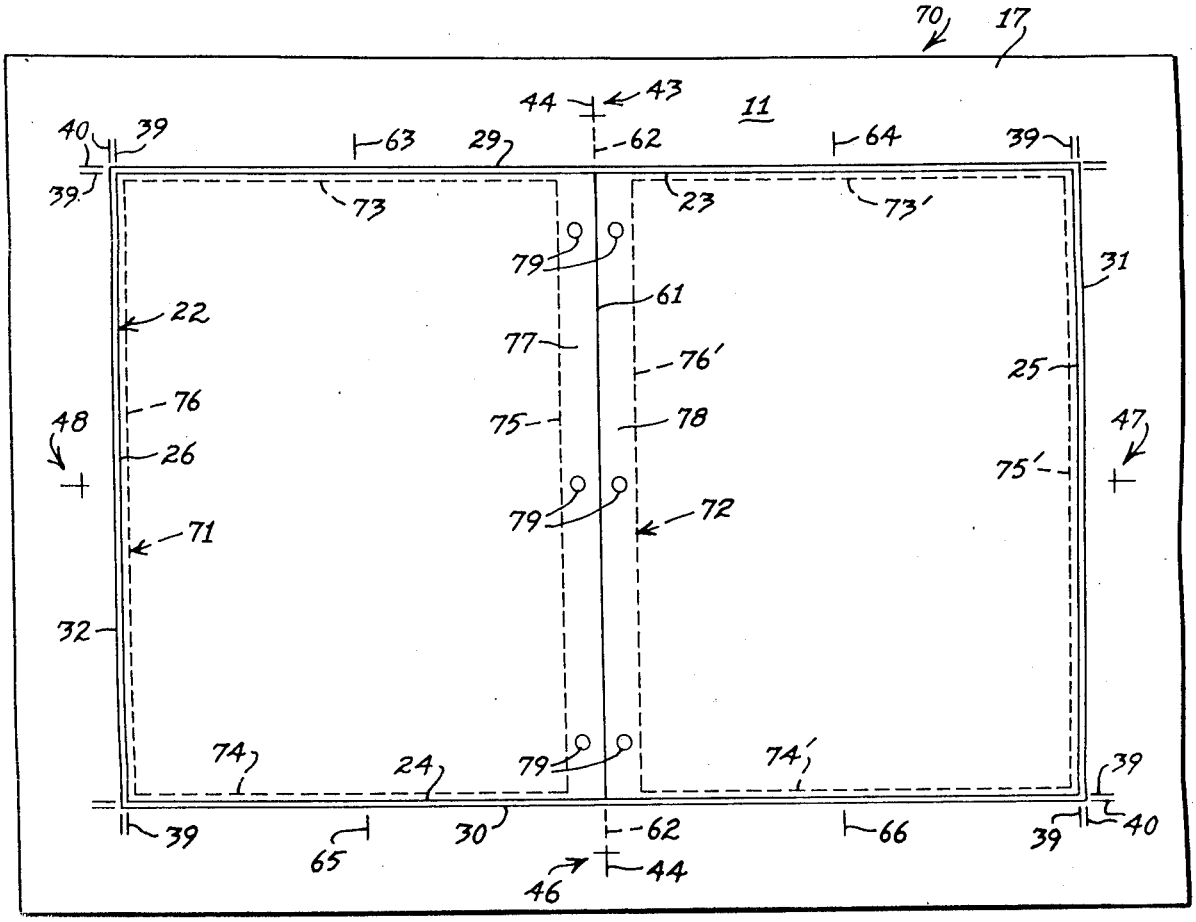
FIG. 5 is a view similar to FIG. 4 of a modified art board adapted to produce two pages adapted for a binder.

The art sheet 17 of the art board 70 disclosed in FIG. 5 is identical the art sheet 17 of to the art board 60 disclosed in FIG. 4, except that the art board 70 is designed to provide two adjacent pages of advertising material adapted to fit within a binder.

Instead of the hazard border 34, two identical rectangular dashed-line hazard borders 71 and 72 are permanently impressed upon the face surface 11 within the trim border 22 as "disappearing lines" in FIG. 5. The left page hazard border 71 includes a top hazard line 73, a bottom hazard line 74, a right side hazard line 75, and a left side hazard line 76. In like manner, the right page hazard border 72 includes a top hazard line 73', a bottom hazard line 74', a right side hazard line 75', and a left side hazard line 76'.

The side hazard lines 75 and 76' are each spaced from the center fold line 61 a distance greater than the spacing between the remaining hazard lines of the hazard borders 71 and 72 and the corresponding trim lines in the trim border 22 to provide the binder spaces 77 and 78. In each of the binder spaces 77 and 78 are a plurality of longitudinally spaced and aligned "disappearing" binder hole marks or circles 79, which provide the same function as the binder space 52 and binder hole marks 53 disclosed in the art sheet 17 of the art board 50 of FIG. 3.

Figure 6:
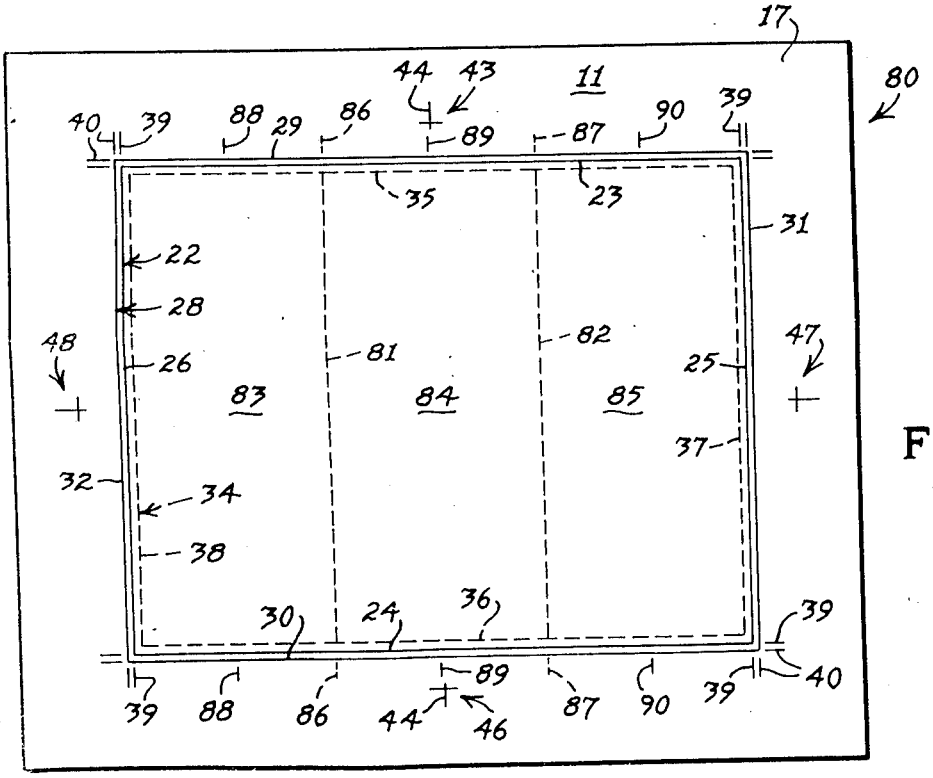
FIG. 6 is a view similar to FIG. 4 disclosing a modification of an art board designed for the production of a three-panel folder.

The art board 80 disclosed in FIG. 6 is designed for the preparation of a single sheet of advertising material which is folded upon itself twice to provide a three-panel folder. The structure of the art sheet 17 of the art board 80 with its imprinted lines and markers is somewhat similar to the structure of the art sheet 17 of the art board 60, except additional fold and center lines are added to permit the double folding to form a three-panel advertising folder, instead of the single folding to provide a two-page leaflet prepared from the art board 60.

Two "disappearing" fold lines 81 and 82 are shown as dashed lines in FIG. 6 within the hazard border 34 and located parallel to the side hazard lines 37 and 38. The fold lines 81 and 82 roughly divide the rectangular area defined by the hazard border 34 into thirds, or three panels, panel areas or work areas 83, 84, and 85 which are almost the same. Each of the fold lines 81 and 82 is provided with upper and lower fold extension lines 86 and 87 located outside the bleed line border 28 and permanently impressed in dark ink upon the face 11 of the art sheet 17 of the art board 80, so that they appear in the final printed material.

Each of the panels 83, 84 and 85 is provided with corresponding upright or vertical center "disappearing" extension lines 88, 89, and 90, each of which is located midway between the sides of the corresponding panels 83, 84, and 85.

Since a three-panel advertising folder must be prepared in such a manner that the marginal edges of the folded panels are flush, the right panel area 85 is slightly wider than the remaining panel areas 83 and 84. This discrepancy is illustrated by the fact that the center extension lines 89 of the center panel 84 are offset to the left of an imaginary center line connecting the center register lines 44 of the top and bottom register marks 43 and 46. Thus, when a three-page advertising folder is prepared and printed from the art sheet 17 of the art board 80, the outside page or panel which is prepared from the panel area 83 is first folded across the middle page prepared from the middle panel 84. Then the wider outside printed page produced from the panel area 85 is folded over the outside of the other side prepared from the page 83, so that the edge corresponding to the side trim line 25 is flush with the edge corresponding to the fold line 81.

Figure 7:
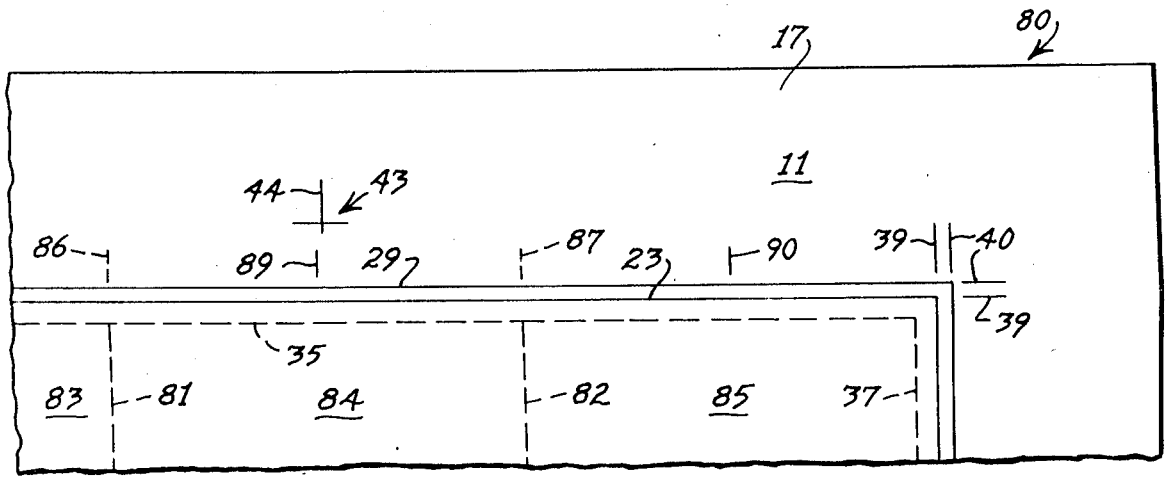
FIG. 7 is an enlarged fragmentary face plan view of the upper right-hand portion of the art board disclosed in FIG. 6.

FIG. 7 is an enlarged fragmentary view of the upper right-hand portion of the art board 80 to further illustrate the discrepancies between the center extension line 89 and the center register line 44 of the top register mark 43.

Figure 8:
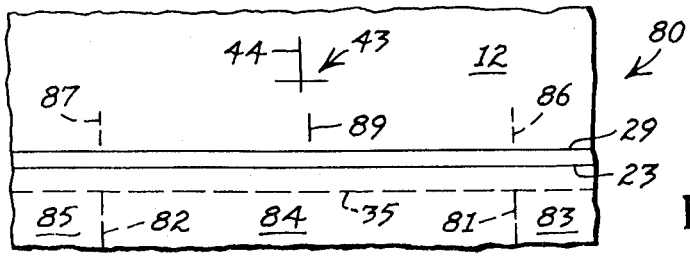
FIG. 8 is an enlarged fragmentary rear plan view of the art board disclosed in FIG. 7.

FIG. 8 illustrates the same offset relationship between lines 89 and 44 impressed upon the back surface 12 of the art board 80.

It is therefore apparent from the disclosures of the various modified art sheets 17 of the art boards 10, 50, 60, 70, and 80, that a pre-lined art sheet, in which all of the lines and marks are permanently impressed upon the appropriate face surface of the art sheet, has been constructed which can be utilized for the complete preparation of the respective advertising material from the creation of the lay-out to the final printed advertising literature, without the addition of any other borders, lines, markings, or fold lines. The pre-lined art sheets made in accordance with this invention provide for the complete preparation of the advertising material with a minimum of errors and a reduction in time which results in a more accurate printed advertising material, with a substantial reduction in cost.

Pre-lined art sheets made in accordance with this invention can be, and have been, pre-printed in computer operated printing machines having an accuracy of 0.001 inches.

As previously mentioned, although the art sheet 17, after it has been pre-printed with all of its lines and markings, may be used alone, preferably the sheet 17 is affixed to a chip board backing 18 of predetermined thickness to provide a rigid art board where rigidity is desired. Moreover, the art sheet 17, after it has been pre-printed, is preferably covered with a coating 19 to permit erasures and cleaning of the face surface 11 with a minimum of smudging.

What is claimed is:

1. A pre-lined art sheet member for use in the preparation of advertising lay-outs and printed advertisements, comprising:

(a) a rectangular sheet having top, bottom, and opposite side edges and a face surface, (b) a rectangular trim border including top, bottom, and opposite side straight trim lines of predetermined lengths permanently impressed upon said face surface, (c) a rectangular bleed border surrounding said trim border and including top, bottom, and opposite sides straight bleed lines spaced outside and parallel to said corresponding top, bottom, and side trim lines, and permanently impressed upon said face surface, (d) a rectangular hazard border inside said trim border and including top, bottom, and opposite side straight hazard lines spaced inside and parallel to said corresponding top, bottom, and side trim lines, and permanently impressed upon said face surface, (e) parallel extension trim and bleed lines colinear with and extending from the opposite ends of all said corresponding trim lines and bleed lines outside said bleed border, and permanently impressed upon said face surface, (f) top and bottom register marks, permanently impressed upon said face surface outside said respective top and bottom bleed lines, and substantially midway between said opposite side trim lines for locating a first center line on said face surface parallel to said opposite side trim lines, (g) opposite side register marks, permanently impressed upon said face surface outside said respective opposite side bleed lines, and substantially midway between said top and bottom trim lines for locating a second center line on said face surface parallel to said top and bottom trim lines.

2. The invention according to claim 1 in which each of said register marks comprises a pair of register lines crossed at right angles to each other, one of said register lines being parallel to an adjacent bleed line.

3. The invention according to claim 2 in which the other of said crossed register lines in each register mark is colinear with the other of said crossed register lines in an opposed register mark on the opposite side of said bleed border.

4. The invention according to claim 1 in which the spacing between all said corresponding bleed lines and trim lines is uniform.

5. The invention according to claim 1 in which said trim border, said bleed border and said hazard border comprise disappearing lines which appear on said rectangular sheet, but do not appear in printed material reproduced photographically from said rectangular sheet, said extension lines and said register marks appearing in said printed material reproduced photographically from said rectangular sheet.

6. The invention according to claim 1 in which the spacing between one of said side trim lines, and its adjacent corresponding hazard line is greater than the spacing between said other corresponding trim and hazard lines to define an elongated binder space between said one trim line and its corresponding hazard line.

7. The invention according to claim 6 further comprising longitudinally spaced binder hole marks in said binder space.

8. The invention according to claim 1 further comprising a center fold line parallel to and substantially midway between said opposite side trim lines to define a pair of page areas on opposite sides of said center fold lines.

9. The invention according to claim 8 in which said trim border, said bleed border, said hazard border and said center fold line comprise disappearing lines which appear on said rectangular sheet, but do not appear in printed material reproduced from said rectangular sheet, said extension lines and said register marks appearing in said printed materials.

10. The invention according to claim 8 further comprising center page extension lines permanently impressed on said face surface outside said top and bottom bleed lines, each set of center page lines being located parallel to and substantially midway between said center fold line and the adjacent opposite side trim line.

11. The invention according to claim 8 further comprising a pair of interior straight hazard lines permanently impressed on said face surface on opposite sides of said center fold line, and substantially parallel to said center fold line to define a pair of adjacent binder spaces on opposite sides of said center fold line.

12. The invention according to claim 11 further comprising longitudinally spaced binder hole marks impressed in each of said binder spaces.

13. The invention according to claim 1 further comprising first and second fold lines permanently impressed upon said face surface, each of said fold lines being substantially $\frac{1}{3}$ the distance between its adjacent side trim line and the opposite side trim line to define a middle rectangular panel area between two side panel areas.

14. The invention according to claim 13 in which said trim border, said bleed border, said hazard border, and said first and second fold lines comprise disappearing lines which appear on said rectangular sheet, but do not appear in printed material reproduced from said rectangular sheet, said extension lines and said register marks appearing in said printed material.

15. The invention according to claim 13 further comprising a set of center extension lines for each panel area permanently impressed upon said face surface outside said corresponding top and bottom bleed lines, two of said center extension line sets being parallel to and substantially midway between a fold line and an adjacent said trim line, the third set of center extension lines being parallel to and substantially midway between said first and second fold lines.

16. The invention according to claim 15 in which one of said side panel areas is sufficiently wider than the other of said side panel areas to permit a three-panel advertising folder made from said rectangular sheet to fold upon itself with registering edges.

17. The invention according to claim 16 in which said top and bottom register marks have colinear center line marks offset from the alignment of the center extension lines of said middle panel areas.

18. The invention according to claim 1 in which said rectangular sheet has a rear surface and a rigid backing board affixed flush against said rear surface.

* * * * *